US010974865B2

(12) United States Patent
Cardoze et al.

(10) Patent No.: US 10,974,865 B2
(45) Date of Patent: Apr. 13, 2021

(54) CONTAINERS WITH FOLDABLE CARRYING HANDLES AND METHOD FOR PREPARING SAME FOR TRANSPORTATION

(71) Applicant: Walmart Apollo, LLC, Bentonville, AR (US)

(72) Inventors: Alexis Cardoze, Hoboken, NJ (US); Omid Sadri, Mahwah, NJ (US); Hany Abdul-Hafez Elkordy, Huntington Beach, CA (US)

(73) Assignee: WALMART APOLLO, LLC, Bentonville, AR (US)

( * ) Notice: Subject to any disclaimer, the term of this patent is extended or adjusted under 35 U.S.C. 154(b) by 0 days.

(21) Appl. No.: 16/561,995

(22) Filed: Sep. 5, 2019

(65) Prior Publication Data

US 2021/0070493 A1 Mar. 11, 2021

(51) Int. Cl.

| | |
|---|---|
| ***B65D 5/468*** | (2006.01) |
| ***B65D 5/10*** | (2006.01) |
| ***B65D 5/02*** | (2006.01) |
| ***B65D 5/04*** | (2006.01) |
| ***B65D 5/20*** | (2006.01) |
| ***B65B 5/02*** | (2006.01) |
| ***B65B 5/04*** | (2006.01) |

(52) U.S. Cl.

CPC ..... *B65D 5/4608* (2013.01); *B65B 5/024* (2013.01); *B65B 5/04* (2013.01); *B65D 5/10* (2013.01); *B65D 5/2052* (2013.01)

(58) Field of Classification Search

CPC ..... B65D 5/4608; B65D 5/10; B65D 5/2052; B65D 5/46112; B65D 5/46096; B65D 5/46144; B65D 2571/00512; B65D 5/001

USPC ..... 229/117.14, 117.15, 117.22, 103, 194, 229/915; 206/549

See application file for complete search history.

(56) References Cited

U.S. PATENT DOCUMENTS

| | | | |
|---|---|---|---|
| 2,454,573 | A | 11/1948 | Scher |
| 4,403,728 | A | 9/1983 | Koltz |
| 4,981,254 | A | 1/1991 | Depper |

(Continued)

FOREIGN PATENT DOCUMENTS

| | | |
|---|---|---|
| JP | 2017193363 | 10/2017 |

*Primary Examiner* — Christopher R Demeree

(74) *Attorney, Agent, or Firm* — Bryan Cave Leighton Paisner LLP

(57) ABSTRACT

A container configured to hold one or more items for transportation. The container can comprise: a base; two opposing end walls; two opposing sidewalls; and a lid. The opposing side walls each can comprise a side flap with an opening. The lid can comprise two opposing top panels and two handle flaps. Each of the two opposing top panels can be foldably coupled to a different one of the two opposing end walls. Each of the two handle flaps can be foldably coupled to a different one of the two opposing top panels. When the container is in a closed configuration, a handle can be formed by the two handle flaps and comprise two engagement end tabs located at two opposing ends of the handle. The handle can be removably coupled to the side flaps by the engagement end tabs engaging with the openings of the side flaps. The handle can be configured to be rotatable while the engagement end tabs remain engaged with the openings of the side flaps. Other embodiments are disclosed.

21 Claims, 7 Drawing Sheets

(56) References Cited

U.S. PATENT DOCUMENTS

| | | | | |
|---|---|---|---|---|
| 5,275,331 | A | 1/1994 | Chung-Piao | |
| 9,139,359 | B1 * | 9/2015 | Simpson | B65D 5/46112 |
| 9,499,294 | B1 * | 11/2016 | Costanzo, Jr. | B65D 5/4612 |
| 9,533,790 | B2 | 1/2017 | Williams | |
| 9,981,770 | B2 * | 5/2018 | Mundt | B65D 5/46112 |
| 10,077,130 | B1 * | 9/2018 | Fron | B65D 5/46096 |
| 10,239,654 | B2 * | 3/2019 | Choi | B65D 5/10 |
| 10,322,840 | B2 * | 6/2019 | Angulo | B65D 77/2024 |
| 10,524,447 | B1 * | 1/2020 | Tayebi | B65D 5/3642 |
| 10,543,951 | B2 * | 1/2020 | Costanzo, Jr. | B65D 81/3813 |
| 2001/0004088 | A1 | 6/2001 | Lau | |
| 2007/0210143 | A1 | 9/2007 | Ogden | |

* cited by examiner

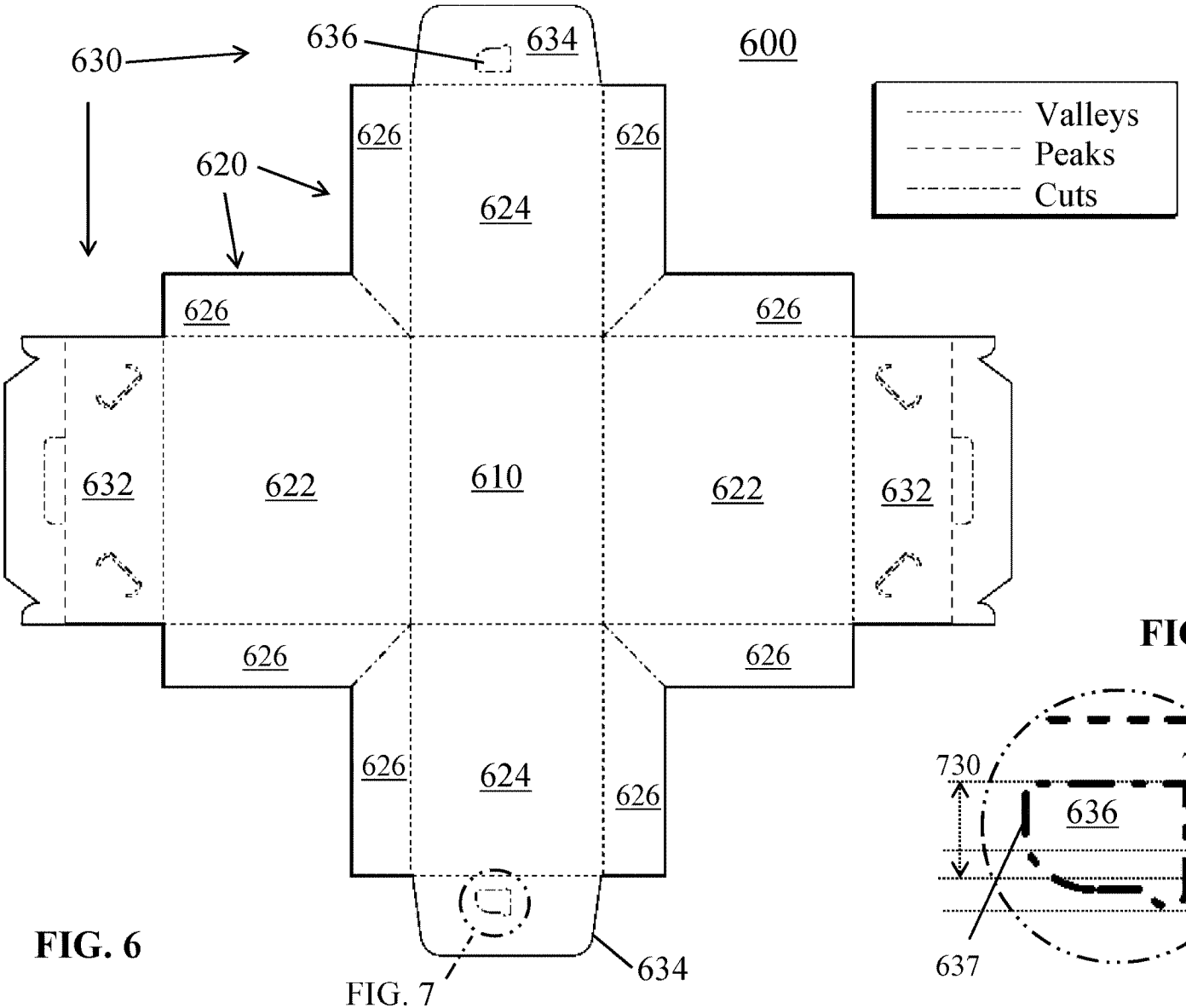
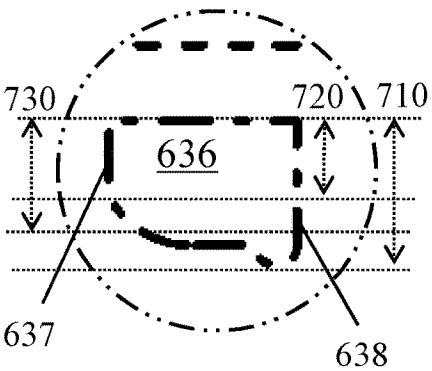
FIG. 7
FIG. 6

CONTAINERS WITH FOLDABLE CARRYING HANDLES AND METHOD FOR PREPARING SAME FOR TRANSPORTATION

TECHNICAL FIELD

This disclosure relates generally to containers and methods for preparing such containers for transportation.

BACKGROUND

Corrugated boxes are very popular containers for transporting goods. They are generally affordable, light weight, reusable, and easy to be collapsed and stored away. Boxes with handles can be easy to carry around. But having handles generally means that such boxes need to be partially collapsed before being transported with other boxes and further re-assembling after transportation, which can be time consuming. Boxes with handles that can be folded and un-folded easily are desired.

BRIEF DESCRIPTION OF THE DRAWINGS

To facilitate further description of the embodiments, the following drawings are provided in which:

FIG. 6 illustrates a top plan view of a box blank for a container with a foldable carrying handle, according to an embodiment;

FIG. 7 illustrates an enlarged view of a circled portion in FIG. 6;

Figure 1:
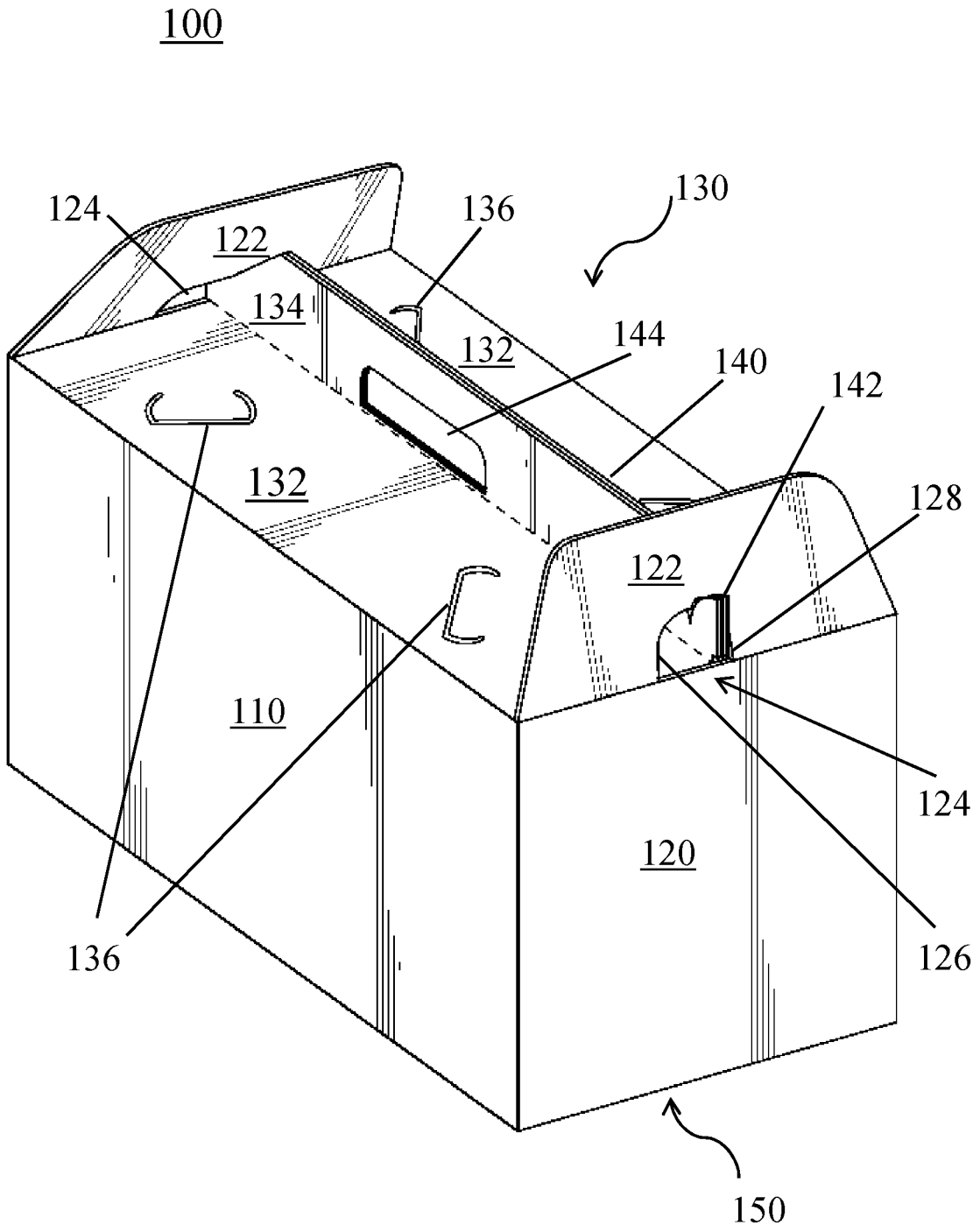
FIG. 1 illustrates a front perspective view of a container with a foldable carrying handle in a closed configuration, according to an embodiment.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements mechanically and/or otherwise. Two or more electrical elements may be electrically coupled together, but not be mechanically or otherwise coupled together. Coupling may be for any length of time, e.g., permanent or semi-permanent or only for an instant. "Electrical coupling" and the like should be broadly understood and include electrical coupling of all types. The absence of the word "removably," "removable," and the like near the word "coupled," and the like does not mean that the coupling, etc. in question is or is not removable.

As defined herein, two or more elements are "integral" if they are comprised of the same piece of material. As defined herein, two or more elements are "non-integral" if each is comprised of a different piece of material.

As defined herein, "approximately" can, in some embodiments, mean within plus or minus ten percent of the stated value. In other embodiments, "approximately" can mean within plus or minus five percent of the stated value. In further embodiments, "approximately" can mean within plus or minus three percent of the stated value. In yet other embodiments, "approximately" can mean within plus or minus one percent of the stated value.

As defined herein, "real-time" can, in some embodiments, be defined with respect to operations carried out as soon as practically possible upon occurrence of a triggering event. A triggering event can include receipt of data necessary to execute a task or to otherwise process information. Because of delays inherent in transmission and/or in computing speeds, the term "real-time" encompasses operations that occur in "near" real-time or somewhat delayed from a triggering event. In a number of embodiments, "real-time" can mean real-time less a time delay for processing (e.g., determining) and/or transmitting data. The particular time delay can vary depending on the type and/or amount of the data, the processing speeds of the hardware, the transmission capability of the communication hardware, the transmission distance, etc. However, in many embodiments, the time delay can be less than approximately one second, five seconds, ten seconds, thirty seconds, one minute, five minutes, ten minutes, or fifteen minutes.

DESCRIPTION OF EXAMPLES OF EMBODIMENTS

Various embodiments include a container for transporting items placed inside the container. In many embodiments, the container can comprise: (a) a base; (b) two opposing end walls; (c) two opposing sidewalls; and (d) a lid. Each of the opposing end walls and each of the opposing sidewalls can extend from the base. The opposing side walls each can be coupled to the opposing end walls and comprise a side flap with an opening. The lid can comprise two opposing top panels and two handle flaps. Each of the two opposing top panels of the lid can be foldably coupled to a different one of the two opposing end walls. Each of the two handle flaps of the lid can be foldably coupled to a different one of the two opposing top panels.

The container can have one or more configurations, such as one or more of an open configuration, a closed configuration, a stackable configuration, or a collapsed configuration. When the container is in the closed configuration, a single, integrated handle can be formed by the two handle flaps. The handle can be configured for a user to hold the handle and carry the container. In some embodiments, the handle can comprise a handle hole in the center. In a number of embodiments, the handle of the container can comprise two engagement end tabs located at two opposing ends of the handle. The handle can be removably coupled to the side flaps of the two opposing sidewalls by the two engagement end tabs engaging with the openings of the side flaps. In many embodiments, the handle can be configured to be rotatable in a downward rotation or an upward rotation while the engagement end tabs remain engaged with the openings of the side flaps. In many embodiments, the handle can be configured so that the user can easily rotate the handle, downward or upward, with a single hand.

In a number of embodiments where the container is in the closed configuration, the container can change from the closed configuration to the stackable configuration, where the handle and the side flaps lie substantially flat on at least one of the two opposing top panels and while the engagement end tabs remain engaged with the openings. In some embodiments, the openings of the side flaps can be configured so that, during the downward rotation of the handle, the engagement end tabs push the side flaps down. In several embodiments, the openings of the side flaps can be configured so that the handle is rotatable only in a single direction to lie substantially flat on at least one of the two opposing top panels. In a few embodiments, at least one of the openings of the side flaps can comprise an edge configured to prevent the handle from the downward rotation in a direction opposite the single direction.

In a number of embodiments, each of the openings of the side flaps can comprise: (a) a first height of the opening at a center of the side flap in which the opening is located, where the first height can be approximately equal to a height of the engagement end tab that is configured to engage the opening; (b) a second height at a side edge of the opening, where the second height can be approximately equal to a width of the engagement end tab that is configured to engage the opening; and (c) a third height between the center of the side flap and the side edge of the opening, wherein the third height can be less than the first height and greater than the second height.

In many embodiments, the container can be formed from a single corrugated box blank. In a number of embodiments, the container can be formed from a single box blank of any suitable materials, such as plastic, resin, metal, etc. In some embodiments, the single corrugated box blank can be formed from a single, unitary piece of material that is cut, scored and folded together. In some embodiments, the single corrugated box blank also can be glued and/or stapled together. In some embodiments, the container can be formed by the single corrugated box blank of any suitable flute grade. As well known in the art, a corrugated box blank can be made of a corrugated fiberboard that generally comprises a fluted corrugated sheet and one or two flat linerboards. The flute refers to the structure of the wave-shaped corrugated medium. An alternate corrugated box blank can be made of a double wall material with two different types of corrugated fiberboards coupled together. Single-wall corrugated fiberboards can be classified into "A", "B", "C", "D," "E," and "F" flute grades based on the number of flutes per linear foot, also known as the flute size or the flute profile. Double-wall corrugated fiberboards can be mixed and matched from the single-wall corrugated fiberboards. Generally, corrugated fiberboards with larger flutes perform better in terms of cushion and strength, and those with smaller flutes have better foldability and printing surfaces. Nonetheless, the definition of the grades and the actual flute dimensions of corrugated fiberboards in each grade can vary slightly from one manufacturer to another.

In some embodiments, the container can be collapsible into a flat configuration for easy storage when not in use. In such and other embodiments, the container can be configured to be easily collapsed and re-assembled by laypersons, thus having increased reusability and sustainability. In some embodiments, the container can comprise (a) one or more base panels, (b) four top panels, and (c) four sidewalls. In these and other embodiments, each of the one or more base panels can be foldably coupled to a different one of the sidewalls, and each of the top panels can be foldably coupled to a different one of the sidewalls. In some embodiments with multiple base panels, each of the base panels can be coupled to at least one another base panel to form the base when the container is in the open, close, or stackable configuration. In these and other embodiments, the base panels can be easily decoupled from each other and top panels too can be easily decoupled from each other so that the container can be collapsed by folding along two opposing scorelines, i.e., folding lines, between the adjacent sidewalls in the flat configuration. In a number of embodiments, the two opposing sidewalls and the base each further can comprise one or more additional scorelines so that the container is collapsible along the one or more additional scorelines to form a substantially flat configuration for the container. In several embodiments, the container further can include one or more aesthetic and/or functional features on at least one surface, such as trademarks, service marks, and/or trade names on the exterior surfaces of the sidewalls and/or the end walls, either by printing, painting, stamping, etc., so that when the container is used for delivery or reuse by consumers, it can serve as a vehicle for free advertisement.

In a few embodiments, at least one of the two opposing top panels can further comprise slits or openings each configured to receive a side corner of one of the two side flaps when the slide flaps lie substantially flat on that top panel. Such slits or openings on the top panel can be of any suitable shape, such as narrow rectangular, crescent shaped, semicircular, substantially U-shaped, substantially triangular, etc.

Further, various embodiments can include a box blank configured to form a container for transporting items. The box blank can comprise: (a) at least one base panel configured to define a base for the container; (b) a series of four wall panels configured to define a wall for the container and foldably connected to the at least one base panel; and (c) a series of four top panels disconnected from each other. In some embodiments, the four wall panels can be disconnected from each other, and each of the wall panels can be foldably connected to the at least one base panel at a respective bottom side. In a number of embodiments, the four wall panels can be foldably connected in a row. In several embodiments, at least one of the four wall panels, but not all of them, is foldably connected to the at least one base panel at a bottom side. For instance, an exemplary embodiment can have a single base panel and four connected wall panels, and only one of the wall panels is foldably connected to the base panel. In another example, an exemplary embodiment can have four base panels each foldably connected to a different one of the four wall panels.

In a number of embodiments, each of the series of four top panels can be foldably connected to a different one of the series of four wall panels. More specifically, each of the series of four top panels can be foldably connected to a top side of a different one of the series of four wall panels, where the top side is at a distal end of the series of four wall panels from the at least one base panel. In some embodiments, a first set of two opposing top panels of the series of four top panels each can define a side flap with an opening. In some embodiments, a second set of two opposing top panels of the series of four top panels can be configured to define a lid and a handle with two engagement end tabs located at two opposing ends of the handle, and the two engagement end tabs can be receivable by the openings of the side flaps.

In a number of embodiments, the opening of each one of the side flaps can taper outwardly, from the center of the side flap. For instance, each of the openings of the side flaps can comprise: (a) a first height of the opening at a center of the side flap in which the opening is located; (b) a second height at a side edge of the opening; and (c) a third height between the center of the side flap and the side edge of the opening. In some embodiments, the first height can be approximately equal to a height of the engagement end tab to be received by the opening, the second height can be approximately equal to a width of the engagement end tab to be received by the opening; and the third height can be in between—less than the first height and greater than the second height. In some embodiments, the opening of each one of the side flaps can be asymmetric along a hypothetical vertical centerline of the opening. For instance, such an opening can comprise a vertical edge at the center of the side flap in which the opening is located so that when the opening is engaged with an engagement end tab, the handle can be rotated only in single direction. In other embodiments, the opening in each one of the side flaps can be symmetric along the hypothetical vertical centerline so that the handle can be rotated in both a clockwise and a counterclockwise direction.

In a number of embodiments, the box blank can have multiple base panels each foldably connected to a different one of the four wall panels and configured to be easily decoupled from each other so that the container formed by the box blank can be collapsible by folding along two opposing scorelines between the wall panels. In some embodiments, two opposing wall panels of the series of the four wall panels and the base panel each further can comprise one or more scorelines so that the container is collapsible along the one or more scorelines to form a substantially flat configuration for the container. In several embodiments, the box blank further can include one or more decorative and/or functional elements on at least one surface, such as trademarks, service marks, and/or trade names on the exterior surfaces of the wall panels, so that the box blank, or the container, when used for delivery or reused by the consumer, can serve as a vehicle for free advertisement. In several embodiments, at least one of the two opposing top panels configured to define a lid can further comprise slits or openings each configured to receive a side corner of one of the two side flaps when the slide flaps lie substantially flat on the lid. Such slits or openings on the lid can be of any suitable shape, such as narrow rectangular, U-shaped, semicircular, or triangular, etc.

Turning to the drawings, FIG. 1 illustrates a front perspective view of a container 100, according to an embodiment. In many embodiments, container 100 can be a container with a foldable carrying handle to transport goods. Container 800 is merely exemplary and is not limited to the embodiments presented herein. Container 800 can be employed in many different embodiments or examples not specifically depicted or described herein.

In many embodiments, container 100 can comprise a base (e.g., base 150 (not shown)), two opposing end walls (e.g., end walls 110), two opposing sidewalls (e.g., sidewalls 120), and a lid (e.g., lid 130). In many embodiments, end walls 110 and sidewalls 120 each can extend from base 150 and each of sidewalls 120 can be coupled to both end walls 110. In some embodiments, sidewalls 120 each can comprise a side flap (e.g., side flap 122), with an opening (e.g., opening 124). In a number of embodiments, lid 130 can comprise two opposing top panels (e.g., top panels 132) and two handle flaps (e.g., handle flaps 134). In some embodiments, each of top panels 132 can be foldably coupled to a different one of end walls 110, and each of handle flaps 134 can be foldably coupled to a different one of top panels 132.

In many embodiments, container 100 can include different configurations (e.g., a closed configuration, in which base 150, end walls 110, sidewalls 120, and lid 130 form a closed internal space). In some embodiments, when container 100 is in the closed configuration as shown in FIG. 1, handle 140 can be formed by handle flaps 134. In a number of embodiments, handle 140 can comprise two engagement end tabs (e.g., engagement end tabs 142), located at two opposing ends of handle 140 and a handle hole (e.g., handle hole 144). In many embodiments, when container 100 is in the closed configuration, handle 140 can be locked securely by side flaps 122 of sidewalls 120, so that a user can carry container 100 by merely holding handle 140. In some embodiments, handle 140 can be locked securely when handle 140 is removably coupled to side flaps 122 by engaging engagement end tabs 142 with openings 124 of side flaps 122.

In several embodiments, handle 140 can be configured to be rotatable in a downward and/or an upward rotation while engagement end tabs 142 remain engaged with openings 124 of side flaps 122. For example, openings 124 of side flaps 122 each can be configured to have sufficient room for two adjacent ones of the four engagement end tabs 142 to rotate upward and/or downward with handle 140 along a virtual axis that extends along a horizontal direction or a length of handle 140. The rotation can be up, to a certain degree, such as ±90 degrees from the vertical position. In certain embodiments, openings 124 each can be configured so that handle 140 can rotate downward only in a single direction (e.g., 0 to −90 degrees, or only counterclockwise) and upward only in a single opposite direction (e.g., 0 to +90 degrees or only clockwise). For example, at least one of openings 124 can have an edge (e.g., edge 128), located near a center of side flap 122 so that handle 140 cannot rotate to the side of edge 128. In some embodiments, when handle 140 is rotated downward while engagement end tabs 142 remains engaged with openings 124, engagement end tabs 142 can be configured to push the side flaps 122 down until handle 140 and side flaps 122 lie substantially flat on at least one of top panels 132.

In some embodiments, top panels 132 can further comprise one or more slits 136. In a number of embodiments, each of slits 136 can be configured to receive a different corner of side flaps 122 when side flap 122 lies substantially flap on the top panels 132. In many embodiments, slits 136 can be of various numbers, shapes, and/or configurations. For example, in an embodiment, top panel 132 in the front of FIG. 1 can have two slits 136 while top panel 132 in the back of FIG. 1 can have none, and vice versa. In another embodiment, top panel 132 at the front side of FIG. 1 can have one slit 136 for retaining side flap 122 on the right of FIG. 1 while top panel 132 at the rear side of FIG. 1 also can have one slit 136 for retaining side flap 122 on the left of FIG. 1. Additionally, each of slits 136 in FIG. 1 can be shaped substantially like a horseshoe. In some embodiments, the shapes of slits 136 each can be rectangular, triangular, semicircular, etc. In some embodiments, the shapes of slits 136 can be different from each other.

Further, in many embodiments, container 100 can be formed from a single corrugated box blank of any suitable flute grade. In some embodiments, sidewalls 120 and base 150 each further can comprise one or more scorelines (not shown) so that container 100 can be collapsible along the one or more scorelines to form a substantially flat configuration for container 100.

Figure 2:
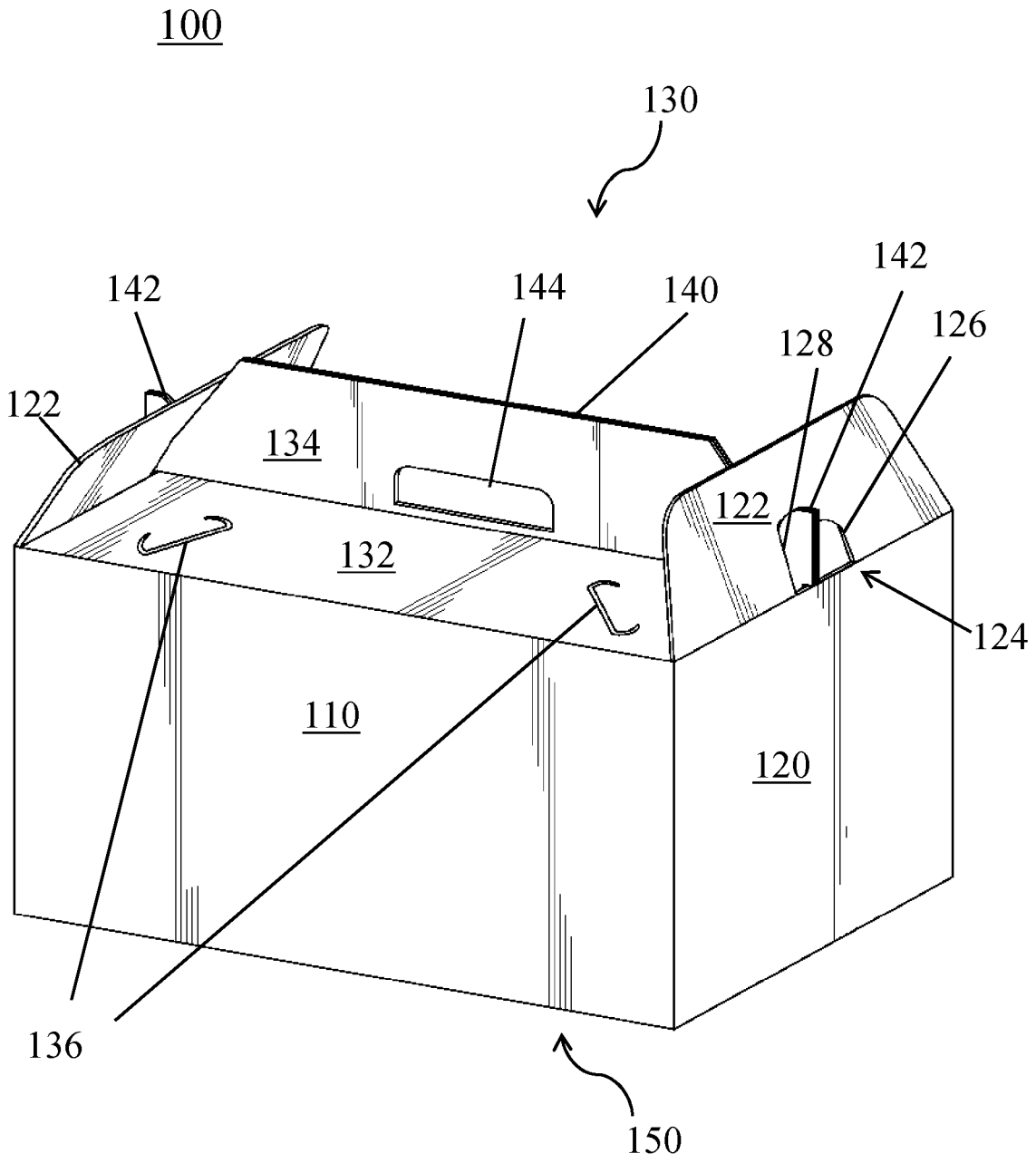
FIG. 2 illustrates a rear perspective view of the container of FIG. 1, according to an embodiment.

Turning to the next drawing, FIG. 2 illustrates a rear perspective view of container 100 of FIG. 1, according to an embodiment. In particular, FIG. 2 shows a different view of openings 124 in side flaps 122 compared to the views of openings 124 in side flaps 122 shown in FIG. 1. Container 100 is shown in FIGS. 1 and 2 in a carrying configuration, where handle 140 is approximately parallel to end walls 110, such that a person can put his fingers through handle hole 144 to grip handle 140 and carry container 100. The carrying configuration also is a closed configuration.

Figure 3:
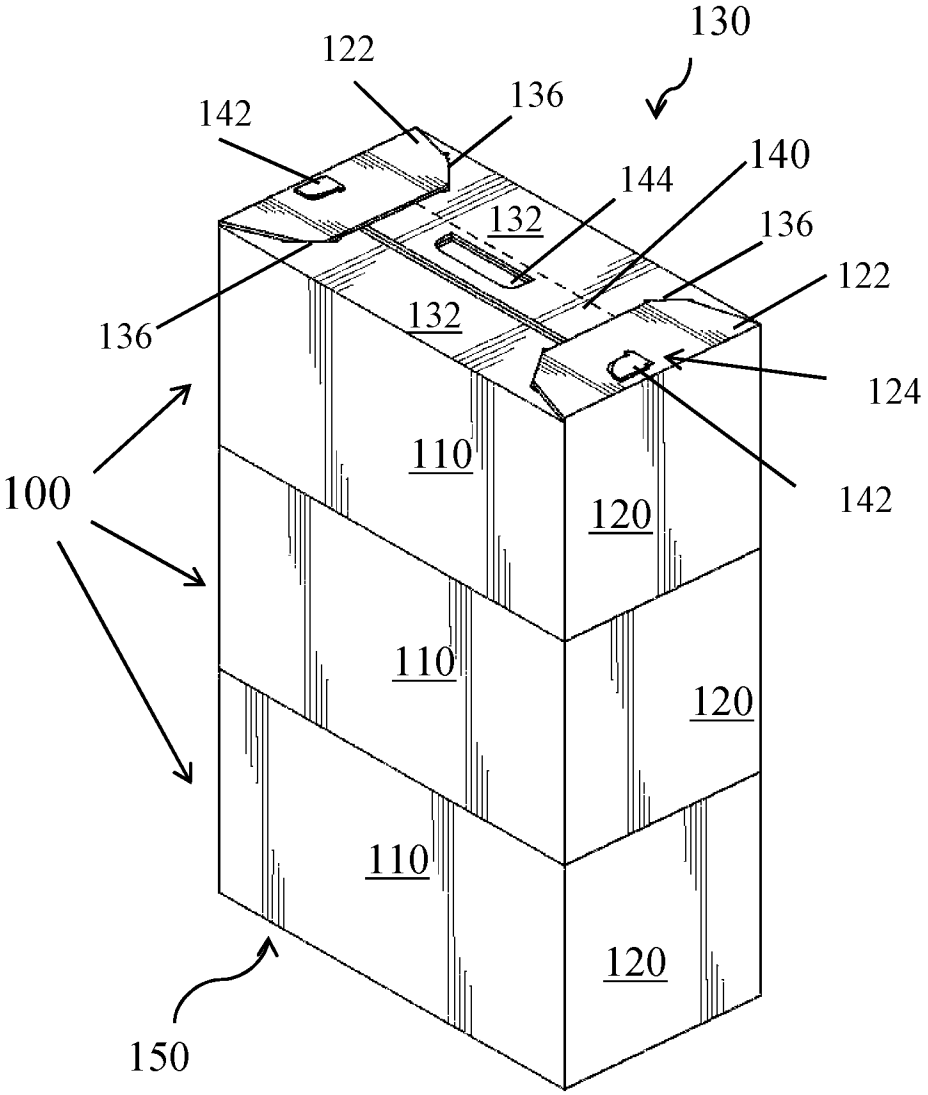
FIG. 3 illustrates a perspective view of three of the same container of FIG. 1 in a stackable configuration and are stacked on top of one other, according to an embodiment.

Turning to the subsequent drawing, FIG. 3 shows a perspective view of three containers of container 100 of FIG. 1 in a stackable configuration and stacked on top of each other, according to an embodiment. The stackable configuration of the containers in FIG. 3 comprises the handles of the containers being folded down or substantially flat against the top panels of the containers. In most embodiments, while in the stackable configuration, the containers also are in a closed configuration, but the containers are not in an open configuration or a carrying configuration. Furthermore, in most embodiments, while the containers are in the stackable configuration, the handle holes are not usable to grip the handles and carry the containers.

Figure 4:
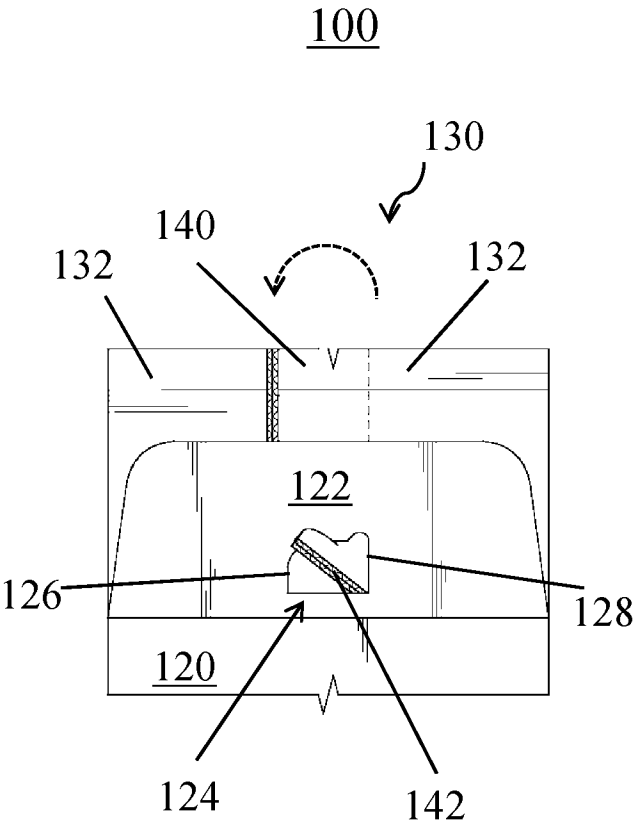
FIG. 4 illustrates an enlarged partial side perspective view of the container of FIG. 1, while the handle is rotated downward, according to an embodiment.

Turning to the next drawing, FIG. 4 shows an enlarged partial side perspective view of container 100, according to an embodiment. In FIG. 4, container 100 is changing from the closed configuration to the stackable configuration, while handle 140 is being rotated downward while engagement end tab 142 remains engaged with opening 124 of side flap 122.

Figure 5:
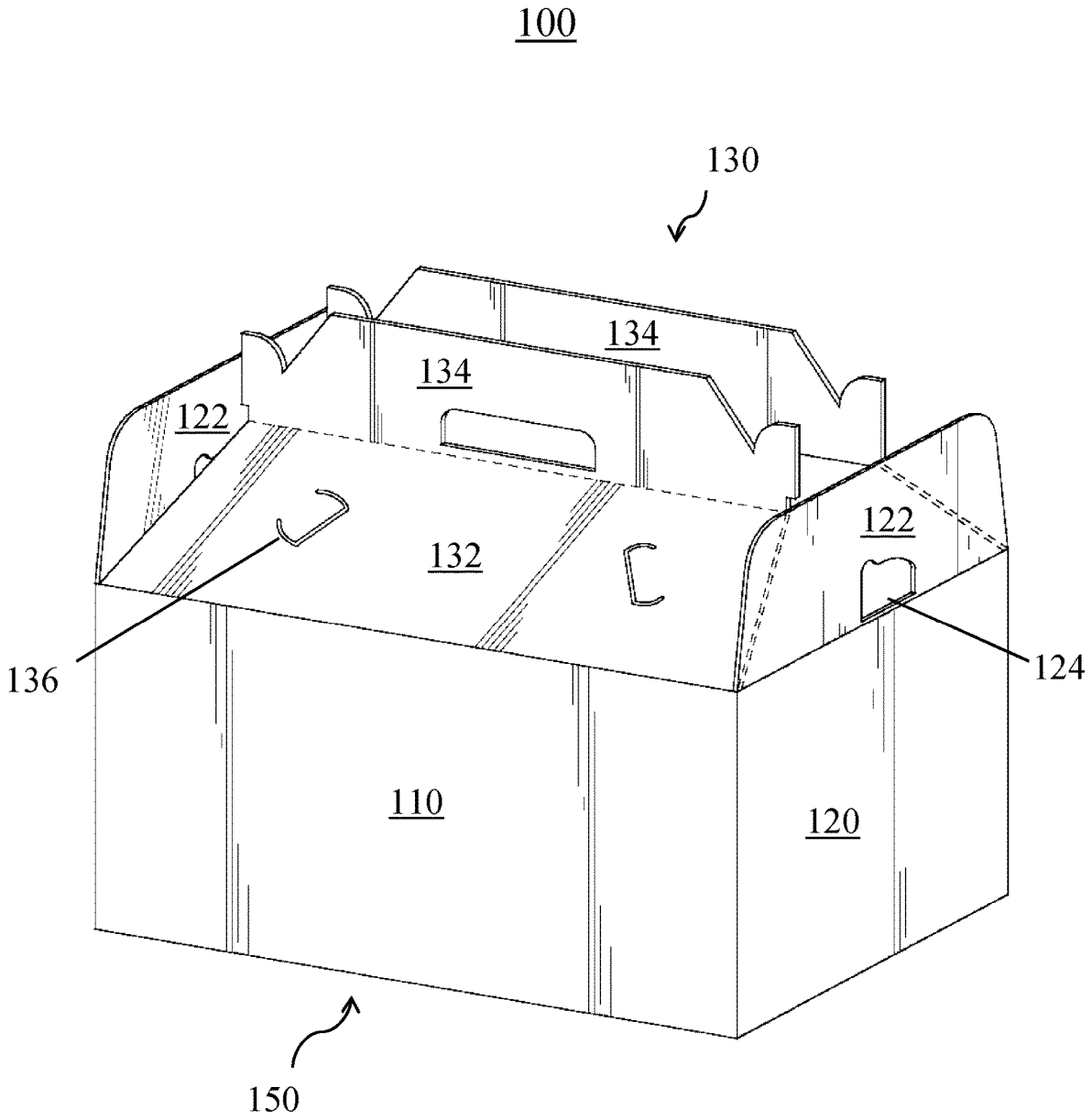
FIG. 5 illustrates a perspective view of the view of a container in a partially open configuration, according to an embodiment.

Turning to the next drawing, FIG. 5 illustrates a perspective view of container 100, according to an embodiment. In FIG. 5, container 100 is shown in a partially open configuration, while container 100 is shown in the closed configuration in FIGS. 1 and 2. In most embodiments, while in the open configuration, the containers are not in the carrying configuration or the stackable configuration, and the handle holes are not usable to grip the handles and carry the containers Turning to the drawings, FIG. 6 illustrates a top plan view of a box blank 600 for a container with a foldable carrying handle, according to an embodiment. In many embodiments, box blank 600 can be used to form a container with a foldable carrying handle to transport goods. Box blank 600 is merely exemplary and is not limited to the embodiments presented herein. Box blank 600 can be employed in many different embodiments or examples not specifically depicted or described herein. In some embodiments, box blank 600 can be used to form container 100 in FIGS. 1-5. As an example, box blank 600 can be folded, as described below, to form container 100 in FIGS. 1-5.

In many embodiments, box blank 600 can comprise at least one base panel (e.g., base panel 610), a series of four wall panels (e.g., wall panels 620), and a series of four top panels (e.g., top panels 630). In some embodiments, base 610 can be configured to define a base for a container (e.g., container 100 (FIG. 1)). In a number of embodiments, wall panels 620 can be configured to define a wall for a container and foldably connected to base panel 610. In many embodiments, top panels 630 can be disconnected from each other. In some embodiments, each of top panels 630 can be foldably connected to only one of wall panels 620 at a top side, distal from base panel 610.

In some embodiments, wall panels 620 can be disconnected from each other, and each can be foldably connected to base panel 610, at a respective bottom side. In embodiments where wall panels are disconnected from each other (e.g., the embodiment shown in FIG. 6), a first set of two opposing top panels of top panels 630 each can define a side flap (e.g., side flap 634) with an opening (e.g., opening 636). In these and other embodiments, a second set of two opposing top panels (e.g., lid top panels 632) of top panels 630 can be configured to define a lid (e.g., lid 130 (FIG. 1)) and a handle (e.g., handle 140 (FIG. 1)) with two engagement end tabs (e.g., engagement end tabs 142 (FIG. 1)) located at two opposing ends of the handle, the two engagement end tabs being receivable by openings 636 of side flaps 634.

In some embodiments, wall panels 620 can be connected in a row. In similar or other embodiments, not all of the wall panels 620 (e.g., 624) can be foldably connected to base panel 610. In embodiments where wall panels 620 are connected, a first set of two nonadjacent top panels of top panels 630 each can define a side flap (e.g., side flap) 634 with an opening (e.g., opening 636). In these and other embodiments, a second set of two nonadjacent top panels (e.g., lid top panels 632) of top panels 630 can be configured to define a lid (e.g., lid 130 (FIG. 1)) and a handle (e.g., handle 140 (FIG. 1)) with two engagement end tabs (e.g., engagement end tabs 142 (FIG. 1)) located at two opposing ends of the handle, the two engagement end tabs being receivable by openings 636 of side flaps 634.

As also shown in FIG. 6, eight portions of box blank 600 are cut to create openings, handle holes, and slits. Additionally, in many embodiments, box blank 600 also can comprise one or more attachment flaps (e.g., attachment flaps 626), each foldably coupled to one (622 or 624) of four wall panels 620 and configured to attach to an adjacent wall panel (624 or 622) of the four wall panels 620 and/or an adjacent attachment flap 626 when the container is formed. In some embodiments, attachment flaps 626 each can attach to another attachment flap 626 by adhesives, staples, or any suitable coupling means.

Turning to the drawings, FIG. 7 shows an enlarged view of a circled portion in FIG. 6. In a number of embodiments, each of openings 636 of side flaps 634 can comprises: (a) a first height (e.g., first height 710) at a center of the side flap in which the opening is located, where first height 710 can be approximately equal to a height of engagement end tab (e.g., engagement end tabs 142 (FIG. 1)) that is configured to engage the opening; (b) a second height (e.g., second height 720) at side edge 637 of the opening, where second height 720 can be approximately equal to a width of the engagement end tab (e.g., engagement end tabs 142 (FIG. 1)) that is configured to engage the opening; and (c) a third height (e.g., third height 730) between the center of the side flap and side edge 637 of the opening, where third height 730 can be less than first height 710 and greater than second height 720.

Figure 8:
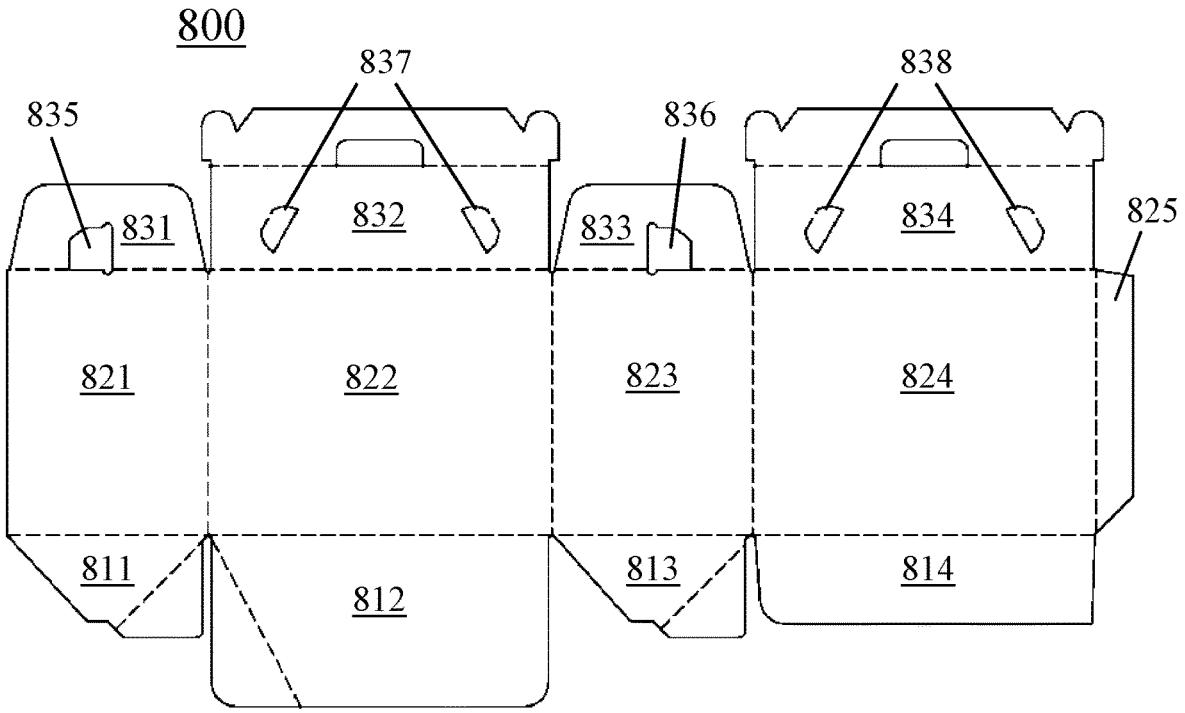
FIG. 8 illustrates a top plan view of a box blank for a container with a foldable carrying handle, according to an alternate embodiment.

Turning to the drawings, FIG. 8 illustrates a top plan view of a box blank 800 for a container with a foldable carrying handle, according to an embodiment. In many embodiments, box blank 800 is substantially similar to box blank 600 in FIG. 6 and can be used to form a container with a single, integrated, foldable carrying handle to transport goods. Box blank 800 is merely exemplary and is not limited to the embodiments presented herein. Box blank 800 can be employed in many different embodiments or examples not specifically depicted or described herein. In some embodiments, box blank 800 can be used to form container 100 in FIGS. 1-5. As an example, box blank 800 can be folded, as described below, to form container 100 in FIGS. 1-5.

In many embodiments, box blank 800 can comprise a series of base panels (e.g., base panels 811, 812, 813 and 814), a series of wall panels (e.g., wall panels 821, 822, 823, and 824), and a series of top panels (e.g., top panels 831, 832, 832 and 834). In some embodiments, base panels 811, 812, 813 and 814 can be configured to define a base for a container (e.g., container 100 (FIG. 1)). In a number of embodiments, wall panels 821, 822, 823, and 824 can be foldably connected in a row and configured to define a wall for the container (e.g., container 100 (FIG. 1)) when the wall panels at the two ends of the row (i.e., wall panels 821 and 824) are coupled together. For example, in the embodiment in FIG. 8, where wall panel 824 further can include an attachment flap (e.g., attachment flap 825), a wall of the container can be formed by folding wall panels 821, 822, 823, and 824 toward each other and affixing attachment flap 825 to wall panel 821, by any suitable means, such as adhesives, hook-and-loop fasteners, etc. In many embodiments, top panels 831, 832, 833, and 834 can be disconnected from each other. In some embodiments, each of top panels 831, 832, 833, and 834 can be foldably connected to a different one of wall panels 821, 822, 823, and 824 at a top side of the box, distal from base panels 811, 812, 813, and 814 at a bottom side of the box.

In embodiments where wall panels are foldably connected in a row (e.g., 821, 822, 823, and 824), a first set of two nonadjacent top panels (e.g., top panels 831 and 833) of top panels 831, 832, 833, and 834 each can define a side flap with an opening (e.g., opening 835 or 836). In these and other embodiments, a second set of two nonadjacent top panels (e.g., top panels 832 and 834) of top panels 831, 832, 833, and 834 can be configured to define a lid (e.g., lid 130 (FIG. 1)) and a handle (e.g., handle 140 (FIG. 1)) with two engagement end tabs (e.g., engagement end tabs 142 (FIG. 1)) located at two opposing ends of the handle, the two engagement end tabs being receivable respectively by opening 835 of side flap 831 or opening 836 of side flap 833. In some embodiments, at least one of top panels 832 and 834 can comprise one or more slits or openings (e.g., 837 or 838). In a number of embodiments, each of the one or more slits or openings (e.g., 837 or 838) on a top panel (e.g., top panel 832 or 834) can be configured to receive a side corner of one of the two side flaps (e.g., top panel 831 or 833) when the respective slide flap (e.g., top panel 831 or 833) lies substantially flat on the lid (e.g., lid 130 (FIG. 1)).

Figure 9:
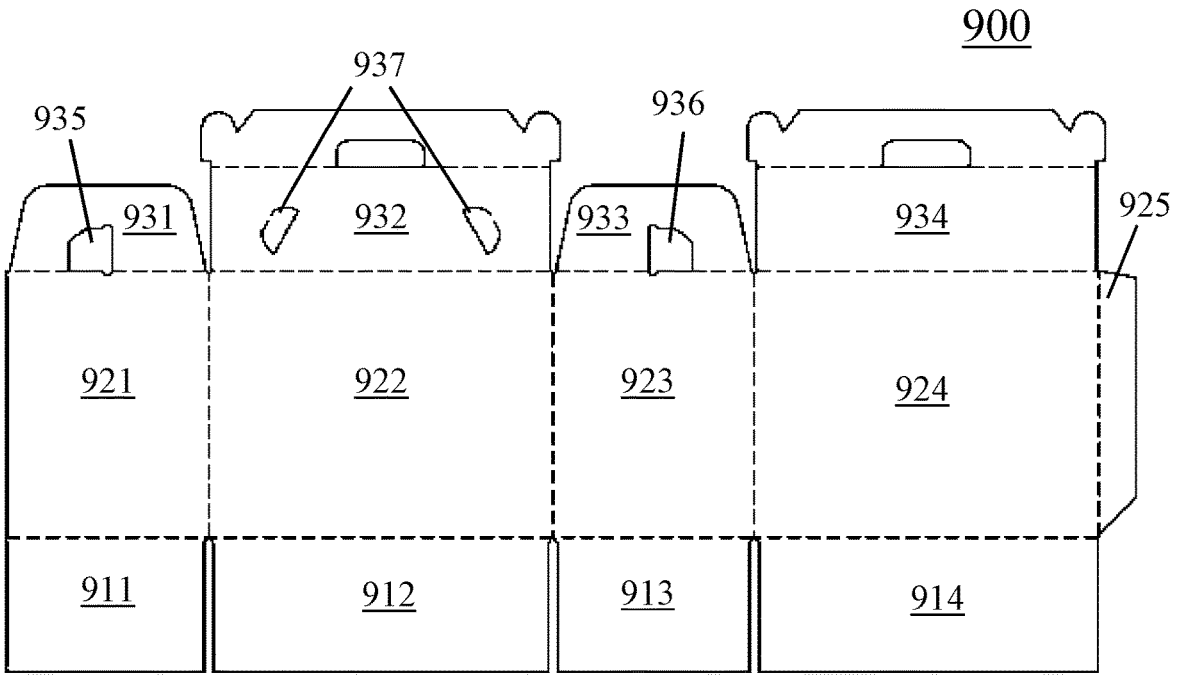
FIG. 9 illustrates a top plan view of a box blank for a container with a foldable carrying handle, according to another embodiment.

Turning to the drawings, FIG. 9 illustrates a top plan view of a box blank 900 for a container with a foldable carrying handle, according to an embodiment substantially similar to the embodiment in FIG. 8. Similar to box blank 800 (FIG. 8), box blank 900 comprise a series of base panels (e.g., base panels 911, 912, 913, and 914), a series of wall panels (e.g., wall panels 921, 922, 923, and 924), and a series of top panels (e.g., top panels 931, 932, 933, and 934) and can be used to form a container with a single, integrated, foldable carrying handle to transport goods. Dissimilar to box blank 800 (FIG. 8), box blank 900 include base panels 911, 912, 913, and 914 that are of different dimensions than those of panels 811, 812, 813, and 814. Additionally, dissimilar to the top panels of box blank 800 (e.g., 832 and 834 in FIG. 8), a top panel of box blank 900 (e.g., 932) can comprise 2 slits (e.g., 937) while a different top panel (e.g., 934) can comprise no slits, and the slits (e.g., 937) can be configured to receive a respective side corner of each of the two side flaps (e.g., 931 and 933) when a container formed from box blank 900 is in a stackable configuration (see, e.g., 100 (FIG. 3)). It is to be understood that box blanks 600 (FIG. 6), 800 (FIG. 8), and 900 are merely exemplary embodiments of a box lank for a container with a foldable carrying handle, and any further suitable alterations in implementations, such as different numbers or shapes of top panels, wall panels, and/or base panels, can be adopted.

Figure 10:
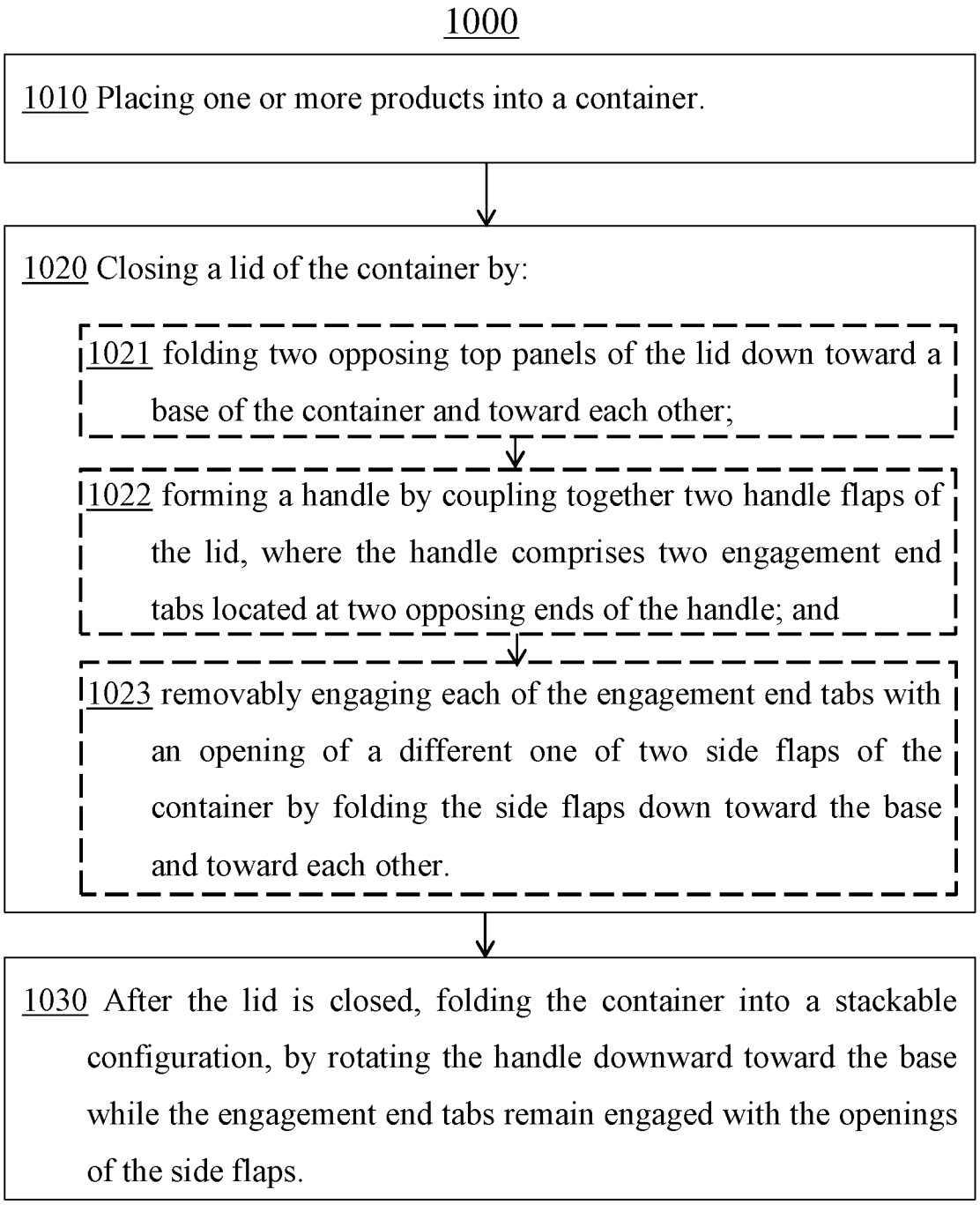
FIG. 10 illustrates a flow chart of a method for using a container with a foldable carrying handle to transport goods, according to an embodiment.

Turning to the drawings, FIG. 10 shows a flow chart of a method 1000, according to an embodiment. In many embodiments, method 1000 can be employed for using a container with a foldable carrying handle to transport goods. Method 1000 is merely exemplary and is not limited to the embodiments presented herein. Method 1000 can be employed in many different embodiments or examples not specifically depicted or described herein. In some embodiments, the activities of method 1000 can be performed in the order presented. In other embodiments, the activities of method 1000 can be performed in any suitable order. In still other embodiments, one or more of the activities of method 1000 can be combined or skipped. In many embodiments, container 100 (FIG. 1) and/or a container formed from a box blank, such as box blank 600 (FIG. 6), box blank 800 (FIG. 8), or box blank 900 (FIG. 9), can be suitable for method 1000 and/or one or more of the activities of method 1000.

In many embodiments, method 1000 can include a block 1010 of placing one or more products into a container, such as container 100 (FIG. 1) and/or the container that can be formed from box blank 600 (FIG. 6). In many embodiments, method 1000 further can include a block 1020 of closing a lid (e.g., lid 130 (FIG. 1)) of the container.

In some embodiments, block 1020 further can include a block 1021 of folding two opposing top panels (e.g., top panels 132 (FIG. 1)), of the lid down toward a base (e.g., base 150 (FIG. 1) of the container and toward each other. In a number of embodiments, block 1020 also can include a block 1022 of forming a handle (e.g., handle 140 (FIG. 1)) by coupling together two handle flaps (e.g., handle flaps 134 (FIG. 1)) of the lid, where the handle comprises two engagement end tabs (e.g., engagement end tabs 142 (FIG. 1)) located at two opposing ends of the handle.

In a number of embodiments block 1020 also can include a block 1023 of removably engaging each of the engagement end tabs (e.g., engagement end tabs 142 (FIG. 1)) with an opening of a different one of two side flaps of the container (e.g., opening 124 (FIG. 1) of side flaps 122 (FIG. 1)), by folding the side flaps (e.g., side flaps 122 (FIG. 1)) down toward the base (e.g., base 150 (FIG. 1)) and toward each other.

In many embodiments, method 1000 additionally can include a block 1030 of folding the container (e.g., container 100 (FIG. 1)) into a stackable configuration (see, e.g., container 300 (FIG. 3)), after the lid (e.g., lid 130 (FIG. 1)) is closed, by rotating the handle (e.g., handle 140 (FIG. 1)) downward toward the base (e.g., base 150 (FIG. 1)) while the engagement end tabs (e.g., engagement end tabs 142 (FIG. 1)) remain engaged with the openings of the side flaps (e.g., opening 124 (FIG. 1) of side flaps 122 (FIG. 1)).

Although systems and methods configured to provide a stackable container with a foldable handle have been described with reference to specific embodiments, it will be understood by those skilled in the art that various changes may be made without departing from the spirit or scope of the disclosure. Accordingly, the disclosure of embodiments is intended to be illustrative of the scope of the disclosure and is not intended to be limiting. It is intended that the scope of the disclosure shall be limited only to the extent required by the appended claims. For example, to one of ordinary skill in the art, it will be readily apparent that any components of the containers or the box blanks disclosed herein, as well as the steps to close and/or stack a container, may be modified, and that the foregoing discussion of certain of these embodiments does not necessarily represent a complete description of all possible embodiments.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A container comprising:

a base;

two opposing end walls, each extending from the base;

two opposing sidewalls, each extending from the base, coupled to the two opposing end walls, and comprising a side flap with an opening; and a lid comprising two opposing top panels and two handle flaps, each of the two opposing top panels being foldably coupled to a different one of the two opposing end walls, and each of the two handle flaps being foldably coupled to a different one of the two opposing top panels, wherein:

when the container is in a closed configuration:

a handle is formed by the two handle flaps;

the handle comprises two engagement end tabs located at two opposing ends of the handle;

the handle is removably coupled to the side flaps of the two opposing sidewalls by the two engagement end tabs engaging with the openings of the side flaps; and the handle is configured to be rotatable in a downward rotation or an upward rotation while the two engagement end tabs remain engaged with the openings.

2. The container of claim 1, wherein the container changes from the closed configuration to a stackable configuration, while the handle and the side flaps lie substantially flat on at least one of the two opposing top panels while the two engagement end tabs remain engaged with the openings.

3. The container of claim 2, wherein the openings of the side flaps are configured so that, during the downward rotation of the handle, the two engagement end tabs push the side flaps down.

4. The container of claim 1, wherein the openings of the side flaps are configured so that the handle is rotatable only in a single direction to lie substantially flat on at least one of the two opposing top panels.

5. The container of claim 4, wherein at least one of the openings of the side flaps comprises an edge configured to prevent the handle from the downward rotation in a direction opposite the single direction.

6. The container of claim 1, wherein the container is formed from a single corrugated box blank.

7. The container of claim 1, wherein the container is devoid of any handles other than the handle.

8. The container of claim 1, wherein:

each of the openings of the side flaps comprises:

a first height of the opening at a center of the side flap in which the opening is located, the first height being approximately equal to a height of an engagement end tab of the two engagement end tabs that is configured to engage the opening;

a second height at a side edge of the opening, the second height being approximately equal to a width of the engagement end tab that is configured to engage the opening; and a third height between the center of the side flap and the side edge of the opening, the third height being less than the first height and greater than the second height.

9. The container of claim 1, wherein the container is collapsible to form a substantially flat configuration for the container.

10. A method of preparing a container for transportation in a stackable configuration, the method comprising steps of:

obtaining the container, wherein the container comprises:

a base;

two opposing end walls extending from the base;

two opposing sidewalls extending from the base, coupled to the two opposing end walls, and comprising side flaps with openings; and a lid comprising two opposing top panels foldably coupled to the two opposing end walls, and further comprising handle flaps foldably coupled to the two opposing top panels;

closing the lid of the container by:

folding the two opposing top panels down toward the base and toward each other;

forming a handle by coupling together the handle flaps to be positioned vertically away from the base, the handle comprising two engagement end tabs located at two opposing ends of the handle; and removably engaging the two engagement end tabs with the openings of the side flaps by folding the side flaps down toward the base and toward each other; and after the lid is closed, folding the container into the stackable configuration, by rotating the handle downward toward the base while the two engagement end tabs remain engaged with the openings of the side flaps.

11. The method of claim 10, wherein the container is devoid of any handles other than the handle.

12. The method of claim 10, wherein the handle and the side flaps lie substantially flat on at least one of the two opposing top panels when the container is in the stackable configuration.

13. The method of claim 12, wherein the openings of the side flaps are configured so that, while the handle is rotated downward, the two engagement end tabs push the side flaps down.

14. The method of claim 10, wherein the openings of the side flaps are configured so that the handle is rotatable only in a single direction to lie substantially flat on at least one of the two opposing top panels.

15. The method of claim 14, wherein at least one of the openings of the side flaps comprises an edge configured to prevent the handle from the downward rotation in a direction opposite the single direction.

16. The method of claim 10, wherein the container is formed from a single corrugated box blank.

17. The method of claim 10, wherein:

each of the openings of the side flaps comprises:

a first height of the opening at a center of the side flap in which the opening is located, the first height being approximately equal to a height of an engagement end tab of the two engagement end tabs that is configured to engage the opening;

a second height at a side edge of the opening, the second height being approximately equal to a width of the engagement end tab that is configured to engage the opening; and a third height between the center of the side flap and the side edge of the opening, the third height being less than the first height and greater than the second height.

18. The method of claim 10, wherein the container is collapsible to form a substantially flat configuration for the container.

19. The method of claim 18 further comprising:

expanding the container by unfolding the two opposing sidewalls and the base before placing one or more products into the container.

20. A box blank comprising:

at least one base panel configured to define a base for a container;

a series of four wall panels configured to define a wall for the container and foldably connected to the at least one base panel; and a series of four top panels disconnected from each other, wherein:

each of the series of four top panels is foldably connected to a top side of a different one of the series of four wall panels, distal from the at least one base panel;

two first opposing top panels of the series of four top panels each are configured to define a respective side flap for the container with a respective opening;

two second opposing top panels of the series of four top panels are configured to define a lid and a handle for the container, wherein:

the handle comprises engagement end tabs located at two opposing ends of the handle, and the engagement end tabs are configured to be receivable by the respective openings of the respective side flaps; and the series of four top panels is configured so that when the container formed by the box blank is in a closed configuration:

the handle is removably coupled to the respective side flaps by the engagement end tabs engaging with the respective openings of the respective side flaps; and the handle is configured to be rotatable in a downward rotation or an upward rotation while the engagement end tabs remain engaged with the respective openings of the respective side flaps.

21. The box blank of claim 20 wherein:

each of the respective openings of the respective side flaps comprises:

a first respective height of the respective opening at a respective center of the respective side flap, the first respective height approximately equal to a height of the engagement end tab receivable by the respective opening;

a second respective height at a respective side edge of the respective opening, the second respective height approximately equal to a respective width of the engagement end tab receivable by the respective opening; and a third respective height between the respective center of the respective side flap and the respective side edge of the respective opening, the third respective height being less than the first respective height and greater than the second respective height.

* * * * *